US007748698B2

(12) United States Patent
Shelhart

(10) Patent No.: US 7,748,698 B2
(45) Date of Patent: Jul. 6, 2010

(54) METHOD AND APPARATUS FOR CONTROLLING A FLUFFER PORT IN AN IMAGE PRODUCTION DEVICE

(75) Inventor: Timothy Gordon Shelhart, West Henrietta, NY (US)

(73) Assignee: Xerox Corporation, Norwalk, CT (US)

( * ) Notice: Subject to any disclaimer, the term of this patent is extended or adjusted under 35 U.S.C. 154(b) by 3 days.

(21) Appl. No.: 12/207,029

(22) Filed: Sep. 9, 2008

(65) Prior Publication Data

US 2010/0059927 A1 Mar. 11, 2010

(51) Int. Cl.
*B65H 3/14* (2006.01)

(52) U.S. Cl. ..... 271/97; 271/98

(58) Field of Classification Search ..... 271/97, 271/98

See application file for complete search history.

(56) References Cited

U.S. PATENT DOCUMENTS

| | | | | |
|---|---|---|---|---|
| 7,249,759 | B2 * | 7/2007 | Komatsu et al. | 271/97 |
| 2005/0133980 | A1 * | 6/2005 | Koga | 271/97 |
| 2006/0175746 | A1 * | 8/2006 | Adachi | 271/97 |
| 2007/0158897 | A1 * | 7/2007 | Soures et al. | 271/97 |

* cited by examiner

*Primary Examiner*—David H Bollinger
(74) *Attorney, Agent, or Firm*—Ronald E. Prass, Jr.; Prass LLP

(57) ABSTRACT

A method and apparatus for controlling a fluffer port in an image production device is disclosed. The method may include receiving an input from one or more sensors; the one or more sensing at least one of media type, media weight, temperature, and humidity, selecting a fluffer port configuration from a plurality of fluffer port configurations based on the received sensor input, and sending a signal to fluff a media stack using the selected fluffer port configuration.

14 Claims, 4 Drawing Sheets

METHOD AND APPARATUS FOR CONTROLLING A FLUFFER PORT IN AN IMAGE PRODUCTION DEVICE

BACKGROUND

Disclosed herein is a method and apparatus for controlling a fluffer port in an image production device.

One of the more challenging aspects of high speed vacuum corrugated media feeder technology in image production devices is assuring the reliable separation of individual sheets of media away from the media stack. This process is initiated via the use of a media fluffing system. However, in image production devices with high-speed, cut sheet feeding, materials often adhere together resulting in multi-feeds and machine shutdowns. Varying media weights and types along with temperature and humidity differences, present challenges for conventional fluffer port configurations.

SUMMARY

A method and apparatus for controlling a fluffer port in an image production device is disclosed. The method may include receiving an input from one or more sensors, the one or more sensors sensing at least one of media type, media weight, temperature, and humidity, selecting a fluffer port configuration from a plurality of fluffer port configurations based on the received sensor input, and sending a signal to fluff a media stack using the selected fluffer port configuration.

DETAILED DESCRIPTION

Aspects of the embodiments disclosed herein relate to a method and apparatus for controlling a fluffer port in an image production device.

The disclosed embodiments may include a method for controlling a fluffer port in an image production device. The method may include receiving an input from one or more sensors; the one or more sensing at least one of media type, media weight, temperature, and humidity, selecting a fluffer port configuration from a plurality of fluffer port configurations based on the received sensor input, and sending a signal to fluff a media stack using the selected fluffer port configuration.

The disclosed embodiments may further include an image production device that may include one or more sensors that sense at least one of media type, media weight, temperature, and humidity, and a fluffer port control unit that receives an input from the one or more sensors, selects a fluffer port configuration from a plurality of fluffer port configurations based on the received sensor input, and sends a signal to fluff a media stack using the selected fluffer port configuration.

The disclosed embodiments may further include a fluffer section for use in an image production device. The fluffer section may include a variable port configuration device that contains a plurality of fluffer port configurations, a stepper motor that moves the variable port configuration device, a variable-speed pressure blower that blows air to fluff a media stack, and a fluffer port control unit that receives an input from one or more sensors that sense at least one of media type, media weight, temperature, and humidity, selects a fluffer port configuration from a plurality of fluffer port configurations based on the received sensor input, sends a signal to the stepper motor to move the variable port configuration device to the selected fluffer port configuration, and sends a signal to the variable-speed pressure blower to blow air to fluff a media stack using the selected fluffer port configuration.

The disclosed embodiments concern a method and apparatus for controlling a fluffer port in an image production device. The process may use a stepper controlled variable port configuration device with several port geometry configurations that may tailor fluffer performance to specific media and ambient conditions, for example. Lightweight, uncoated media in high humidity may require a port with a specific shape, cross sectional area, and vertical location for ideal performance, for example. A heavyweight uncoated in low humidity may require a completely different combination, for example. Coupled with a variable speed blower, a wide range of fluffing air conditions may be provided by this process.

Figure 1:
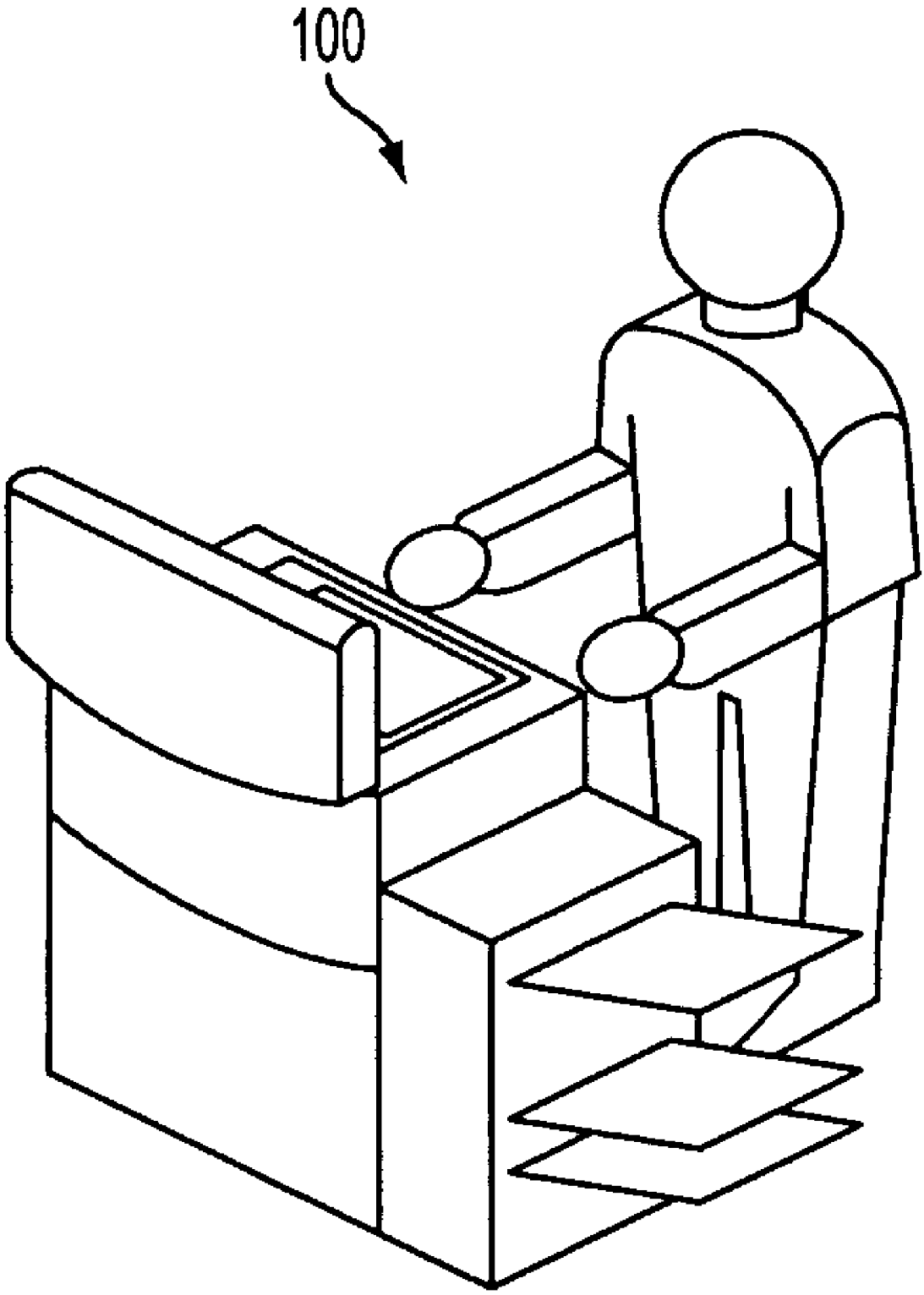
FIG. 1 is an exemplary diagram of an image production device in accordance with one possible embodiment of the disclosure.

FIG. 1 is an exemplary diagram of an image production device 100 in accordance with one possible embodiment of the disclosure. The image production device 100 may be any device that may be capable of making image production documents (e.g., printed documents, copies, etc.) including a printer, a copier, a copier/printer, an office copier/printer, a high-capacity copier/printer, a commercial copier/printer, a facsimile/printer device, or a multi-function device (MFD), for example.

Figure 2:
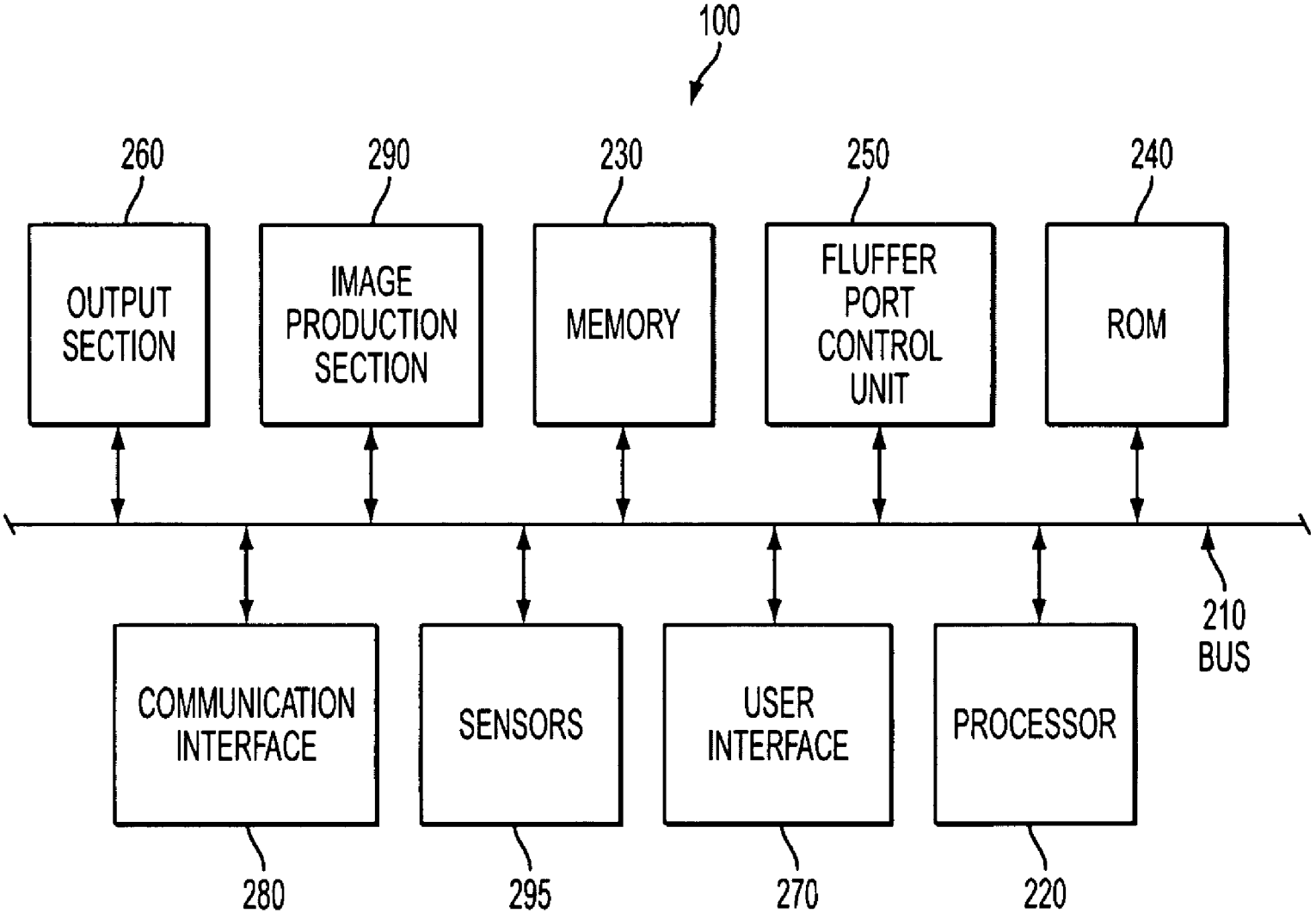
FIG. 2 is a exemplary block diagram of the image production device in accordance with one possible embodiment of the disclosure.

FIG. 2 is an exemplary block diagram of the image production device 100 in accordance with one possible embodiment of the disclosure. The image production device 100 may include a bus 210, a processor 220, a memory 230, a read only memory (ROM) 240, a fluffer port control unit 250, a user interface 260, an output section 270, a communication interface 280, an image production section 290, and sensors 295. Bus 210 may permit communication among the components of the image production device 100.

Processor 220 may include at least one conventional processor or microprocessor that interprets and executes instructions. Memory 230 may be a random access memory (RAM) or another type of dynamic storage device that stores information and instructions for execution by processor 220. Memory 230 may also include a read-only memory (ROM) which may include a conventional ROM device or another type of static storage device that stores static information and instructions for processor 220.

Communication interface 280 may include any mechanism that facilitates communication via a network. For example, communication interface 280 may include a modem. Alternatively, communication interface 280 may include other mechanisms for assisting in communications with other devices and/or systems.

ROM 240 may include a conventional ROM device or another type of static storage device that stores static information and instructions for processor 220. A storage device may augment the ROM and may include any type of storage media, such as, for example, magnetic or optical recording media and its corresponding drive.

User interface 260 may include one or more conventional mechanisms that permit a user to input information to and interact with the image production unit 100, such as a keyboard, a display, a mouse, a pen, a voice recognition device, touchpad, buttons, etc., for example. Output section 270 may include one or more conventional mechanisms that output image production documents to the user, including output trays, output paths, finishing section, etc., for example. The image processing section 290 may include an image printing and/or copying section, a scanner, a fuser, etc., for example.

Sensors 295 may represent any sensors that may be used to sense environmental and media conditions, including sensors that sense the media type being fluffed, the media weight being fluffed, the current temperature, and the current humidity during image production device operation.

The image production device 100 may perform such functions in response to processor 220 by executing sequences of instructions contained in a computer-readable medium, such as, for example, memory 230. Such instructions may be read into memory 230 from another computer-readable medium, such as a storage device or from a separate device via communication interface 280.

The image production device 100 illustrated in FIGS. 1-2 and the related discussion are intended to provide a brief, general description of a suitable communication and processing environment in which the disclosure may be implemented. Although not required, the disclosure will be described, at least in part, in the general context of computer-executable instructions, such as program modules, being executed by the image production device 100, such as a communication server, communications switch, communications router, or general purpose computer, for example.

Generally, program modules include routine programs, objects, components, data structures, etc. that perform particular tasks or implement particular abstract data types. Moreover, those skilled in the art will appreciate that other embodiments of the disclosure may be practiced in communication network environments with many types of communication equipment and computer system configurations, including personal computers, hand-held devices, multi-processor systems, microprocessor-based or programmable consumer electronics, and the like.

Figure 3:
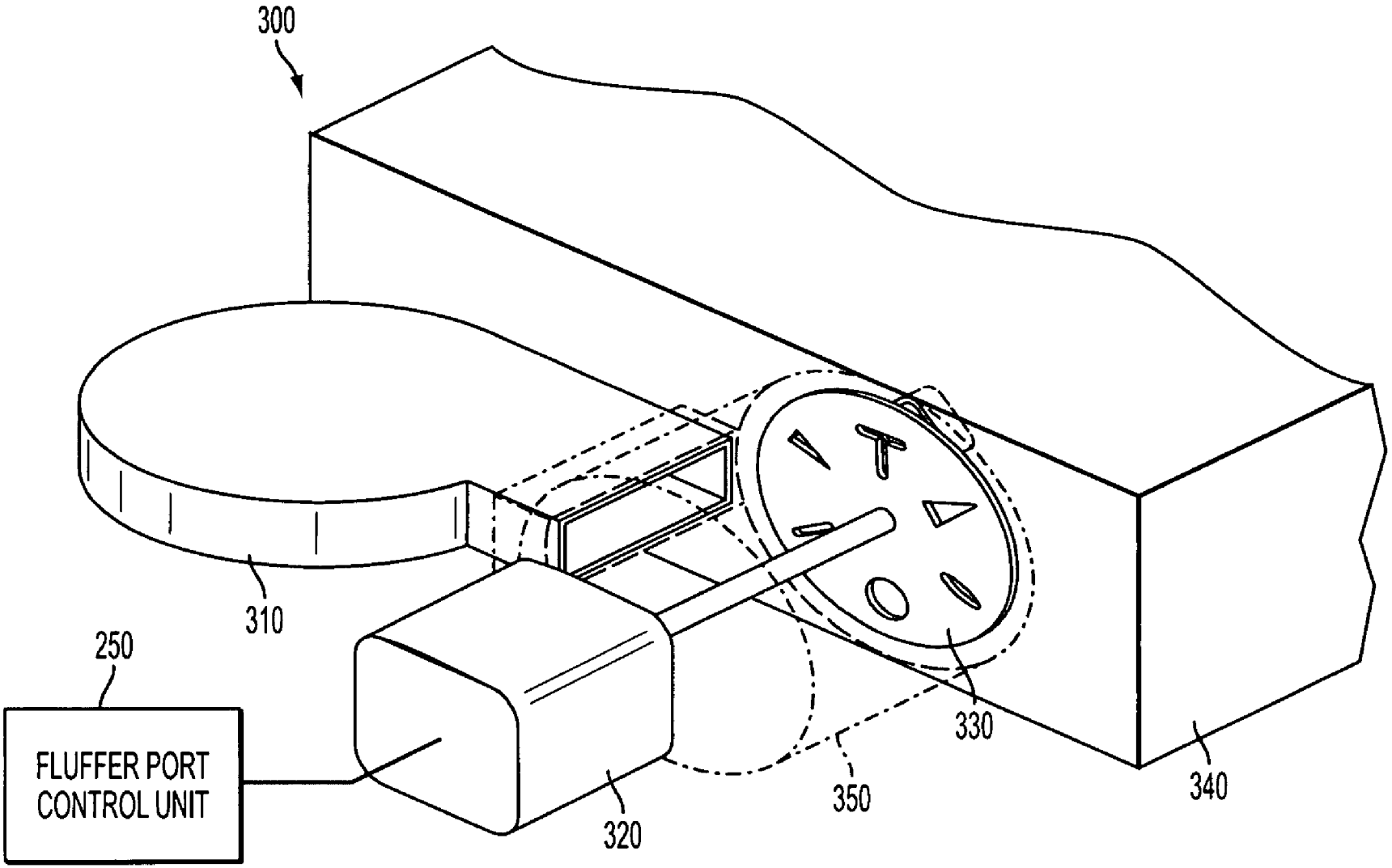
FIG. 3 is a diagram of an exemplary fluffer section in accordance with one possible embodiment of the disclosure.

FIG. 3 is a diagram of an exemplary fluffer section 300 in accordance with one possible embodiment of the disclosure. The fluffer section 300 may be part of the output section 260, the image production section 290, or it may be a separate unit, for example. The fluffer section 300 may fluff the media stack 340 and may include a variable speed pressure blower 310, a stepper motor 320, and a variable port configuration device 330 covered by a plenum 350.

The media stack 340 may represent any type of media used to produce documents in the image production device 100, such as any type of paper, plastic, photo paper, cardboard, etc. The variable speed pressure blower 310 may be any mechanism known to those of skill in the art that may be used to inject air into a media stack 340 in order to provide separation between sheets of media in the stack 340. The stepper motor 320 may represent any motor capable of allowing the variable port configuration device 330 to move or change from one fluffer port configuration to another. The stepper motor 320 may be coupled directly or indirectly to the fluffer port control unit 250. The stepper motor 320 may receive signals from the fluffer port control unit 250 to move the variable port configuration device 330 to a selected port configuration, for example.

The plenum 350 may be manufactured out of any metal, plastic, synthetic, etc. that has an input for the variable speed pressure blower 310 and covers the variable port configuration device 330 so that air is directed through the fluffer port configuration to the media stack 340 for fluffing. The variable port configuration device 330 may be of any shape or size that may allow fluffer ports to be selected for use by the fluffer port control unit 250.

As an example, FIG. 3 shows a possible embodiment where the variable port configuration device 330 is a circular platform that is rotated by the stepper motor 320 to a desired fluffer configuration port. However, the variable port configuration device 330 may be any shape or size as long as it performs the function of providing selectable fluffer port configurations. For example, the variable port configuration device 330 may be a linear mechanism with a stepper motor to slide it back and forth to the selected port configuration. The possible fluffer port configurations may be vertical, horizontal, circular, oval, T-shaped, square, rectangular, cross-shaped, triangular, etc., for example, as long as the shape performs the desired function of media page separation.

Figure 4:
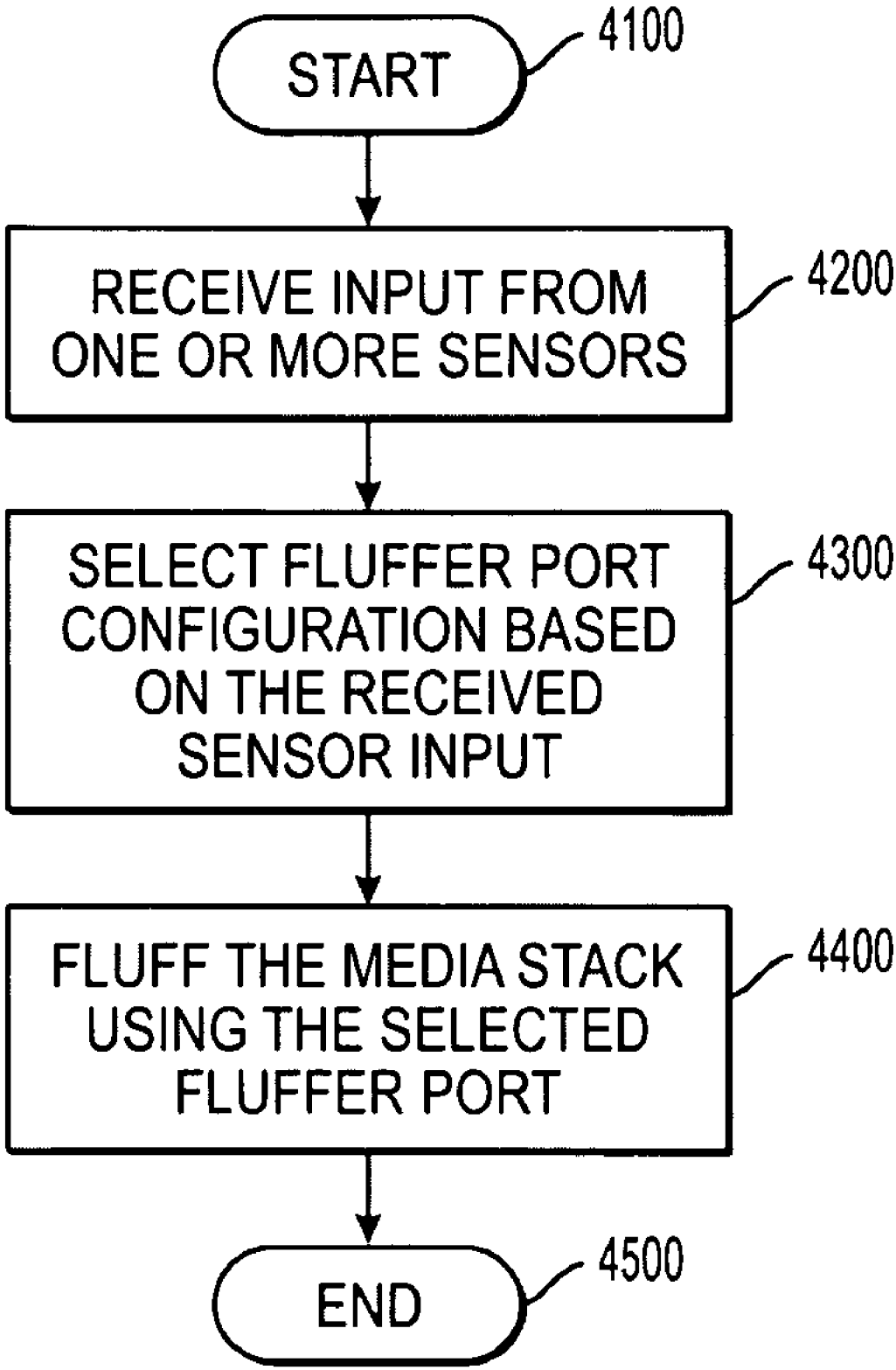
FIG. 4 is a flowchart of an exemplary a fluffer port control process in accordance with one possible embodiment of the disclosure.

For illustrative purposes, the operation of the fluffer port control unit 250 and the exemplary a fluffer port control process are described in FIG. 4 in relation to the diagrams shown in FIGS. 1-3.

FIG. 4 is a flowchart of an exemplary a fluffer port control process in accordance with one possible embodiment of the disclosure. The method begins at 4100, and continues to 4200 where the fluffer port control unit 250 may receive an input from one or more sensors 295. The one or more sensors 295 may sense at least one of media type, media weight, temperature, or humidity, for example. However, the media type and the media weight may be input by a user at a user interface 270, for example.

At step 4300, the fluffer port control unit 250 may select a fluffer port configuration from a plurality of fluffer port configurations based on the received sensor input. In this manner, the fluffer port control unit 250 may select the fluffer port configuration from a plurality of fluffer port configurations that are positioned on a variable port configuration device 330 that may be moved to the selected fluffer port configuration. For example, the stepper motor 320 may move the variable port configuration device 330 to a selected position that will allow the desired air flow through the selected fluffer port configuration and onto the media stack 340.

At step 4400, the fluffer port control unit 250 may send a signal to fluff the media stack 340 using the selected fluffer port configuration. Fluffing may be performed using the variable-speed pressure blower 310. The variable-speed pressure blower 310 may vary its speed based upon the sensor 295 inputs, for example. The process may then go to step 4500 and end.

Embodiments as disclosed herein may also include computer-readable media for carrying or having computer-executable instructions or data structures stored thereon. Such computer-readable media can be any available media that can be accessed by a general purpose or special purpose computer. By way of example, and not limitation, such computer-readable media can comprise RAM, ROM, EEPROM, CD-ROM or other optical disk storage, magnetic disk storage or other magnetic storage devices, or any other medium which can be used to carry or store desired program code means in the form of computer-executable instructions or data structures. When information is transferred or provided over a network or another communications connection (either hard-wired, wireless, or combination thereof to a computer, the computer properly views the connection as a computer-readable medium. Thus, any such connection is properly termed a computer-readable medium. Combinations of the above should also be included within the scope of the computer-readable media.

Computer-executable instructions include, for example, instructions and data which cause a general purpose computer, special purpose computer, or special purpose processing device to perform a certain function or group of functions. Computer-executable instructions also include program modules that are executed by computers in stand-alone or network environments. Generally, program modules include routines, programs, objects, components, and data structures, and the like that perform particular tasks or implement particular abstract data types. Computer-executable instructions, associated data structures, and program modules represent examples of the program code means for executing steps of the methods disclosed herein. The particular sequence of such executable instructions or associated data structures represents examples of corresponding acts for implementing the functions described therein. It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A method for controlling a fluffer port in an image production device, comprising:

receiving an input from one or more sensors, the one or more sensors sensing at least one of media type, media weight, temperature, and humidity;

selecting a fluffer port configuration from a plurality of fluffer port configurations based on the received sensor input; and sending a signal to fluff a media stack using the selected fluffer port configuration.

2. The method of claim 1, wherein at least one of the media type and the media weight are input by a user.

3. The method of claim 1, wherein the fluffer port configuration is selected from a plurality of fluffer port configurations that are positioned on a variable port configuration device that is moved to the selected fluffer port configuration.

4. The method of claim 3, wherein the variable port configuration device is one of a circular platform that is rotated by a stepper motor and a linear mechanism that is moved back and forth by a stepper motor to the selected port configuration.

5. The method of claim 1, wherein the fluffer port configuration is one of vertical, horizontal, circular, oval, T-shaped, square, rectangular, cross-shaped, and triangular.

6. The method of claim 1, wherein the fluffing is performed using a variable-speed pressure blower, the variable-speed pressure blower varying its speed based upon the sensor inputs.

7. The method of claim 1, wherein the image production device is one of a printer, a copier/printer, an office copier/printer, a high-capacity copier/printer, a commercial copier/printer, a facsimile/printer device, and a multi-function device.

8. A fluffer section of an image production device, comprising:

one or more sensors that sense at least one of media type, media weight, temperature, and humidity;

one or more fluffer ports; and a fluffer port control unit that receives an input from the one or more sensors, selects a fluffer port configuration from the plurality of fluffer port configurations based on the received sensor input, and sends a signal to fluff a media stack using the selected fluffer port configuration.

9. The fluffer section of claim 8, wherein at least one of the media type and the media weight are input by a user.

10. The fluffer section of claim 8, further comprising:

a variable port configuration device that includes a plurality of fluffer port configurations, wherein the fluffer port control unit sends a signal to move the variable port configuration device to the selected fluffer port configuration.

11. The fluffer section of claim 10, further comprising:

a stepper motor that moves the variable port configuration device to the selected fluffer port configuration.

12. The fluffer section of claim 8, wherein the fluffer port configuration is one of vertical, horizontal, circular, oval, T-shaped, square, rectangular, cross-shaped, and triangular.

13. The fluffer section of claim 8, further comprising:

a variable-speed pressure blower that blows air to fluff the media stack, the variable-speed pressure blower varying its speed based upon the sensor inputs.

14. The fluffer section of claim 8, wherein the image production device is one of a printer, a copier/printer, an office copier/printer, a high-capacity copier/printer, a commercial copier/printer, a facsimile/printer device, and a multi-function device.

* * * * *